US005584453A

United States Patent [19]

Morter

[11] Patent Number: 5,584,453

[45] Date of Patent: Dec. 17, 1996

[54] APPARATUS FOR SUPPORTING A CONTAINER ON A LADDER RUNG

[76] Inventor: David A. Morter, P.O. Box 2772499, Steamboat Springs, Colo. 80477

[21] Appl. No.: 343,233

[22] Filed: Nov. 22, 1994

[51] Int. Cl.[6] ..... E06C 7/14

[52] U.S. Cl. ..... 248/210; 248/214; 248/311.2

[58] Field of Search ..... 248/210, 211, 248/214, 215, 218.4, 311.2; 220/482; 182/129

[56] References Cited

U.S. PATENT DOCUMENTS

| | | | |
|---|---|---|---|
| 2,544,817 | 3/1951 | White | 248/218.4 |
| 2,911,133 | 11/1959 | Ruggieri | 220/482 X |
| 3,239,181 | 3/1966 | Ellerbrock . | |
| 3,278,148 | 10/1966 | Denaro . | |
| 3,300,167 | 1/1967 | Malicoat . | |
| 3,312,441 | 4/1967 | Molenda . | |
| 3,332,653 | 7/1967 | Hoelzel . | |
| 3,567,038 | 3/1971 | Ammann | 248/210 X |
| 3,895,772 | 7/1975 | Ellingson . | |
| 4,036,463 | 7/1977 | Hopkins et al. . | |
| 4,403,368 | 9/1983 | Harper . | |
| 4,433,822 | 2/1984 | Caggiano . | |
| 4,560,127 | 12/1985 | Ippolito . | |
| 4,580,752 | 4/1986 | Patrick . | |
| 4,787,586 | 11/1988 | Crain . | |
| 4,964,601 | 10/1990 | Dishman . | |
| 5,009,380 | 4/1991 | Fee | 248/214 |
| 5,064,090 | 11/1991 | Farrier | 248/210 X |
| 5,133,525 | 7/1992 | Good . | |
| 5,173,181 | 12/1992 | McFarland | 248/214 X |

*Primary Examiner*—Ramon O. Ramirez
*Assistant Examiner*—Derek J. Berger
*Attorney, Agent, or Firm*—F. A. Sirr; E. C. Hancock; Holland & Hart llp

[57] ABSTRACT

In a paint can assembly adapted to be releasably attached to the rung of a ladder, a relatively wide spring-like metal or plastic strap is attached to the side of a cylindrical or cone shaped paint can body. This strap bends into a downward facing U-shape so as to slip over and tightly conform to a horizontal ladder rung having a generally rectangular cross section. In this manner, the strap snugly conforms to the external surface of the ladder rung and supports the paint can relative thereto. A resilient cord is attached to the bottom of the can body at a position generally opposite to the strap. Tension applied to this cord as the cord is stretched over the lower end of the strap operates to removably secure the paint can to the ladder rung. A removable cover is provided for the can. A disposable liner lines the can body. A resilient cover is provided to convert a ladder rung of circular cross section to a ladder rung of generally rectangular cross section.

32 Claims, 4 Drawing Sheets

APPARATUS FOR SUPPORTING A CONTAINER ON A LADDER RUNG

BACKGROUND OF THE INVENTION

1. Field of the Invention

This invention relates to the field of article supports, and more specifically to a support for holding a container relative to a ladder.

2. Description of the Related Art

The art has provided a variety of arrangements for releasably holding a container such as a paint can relative to a ladder.

An example is U.S. Pat. No. 3,300,167 wherein a strap of sheet metal is secured to a vertically-oriented can, the strap being draped over the steps of a ladder, and the strap then terminating at a handle portion. This patent does not provide a means for securing the can holder to the ladder rung.

U.S. Pat. No. 4,964,601 provides a container for attachment to the side of a ladder, this arrangement secures the container to the ladder by way of elastic bands that wrap about one of the two vertical side rails of an inclined ladder.

U.S. Pat. No. 4,580,752 shows a can that hangs from a ladder rung by the use of a vertically extending hook. An anti-sway device encircles a lower portion of the can, and then secures the can to the next rung down on an inclined ladder.

U.S. Pat. No. 5,133,525 provides a vertical member having an upper hook for engaging an upper ladder rung, and a having a lower horizontal member that supports the bottom of a paint can. This lower horizontal member also extends so as to engage the next lower rung of the inclined ladder. The can is secured to the vertical member.

U.S. Pat. Nos. 3,278,148, 3,239,181, 3,312,441, 3,332,653, 4,036,463 and 4,560,127 relate to can holders of various different constructions in which a can is secured relative to the generally vertical side rail of a ladder.

U.S. Pat. No. 4,433,822 provides a paint can holder for a ladder wherein an inclined member extends between two adjacent ladder rungs of an inclined ladder and a horizontal member ties this member to the ladder's side rail. The paint can is secured to the inclined member.

U.S. Pat. Nos. 3,895,772, 4,403,368 and 4,787,586 provide devices that support a paint can vertically between an inclined ladder's two side rails by providing a support mechanism that extends between two adjacent horizontal ladder rungs.

While the art as exemplified above has been generally successful for its limited intended purposes, the need remains in the art for a paint can assembly which is adapted to be releasably attached to a ladder, wherein a relatively wide, adjustable, U-shaped, spring-like strap is attached to, or extends from, the side of the paint can, and bents down to form a downward facing U-shape so as to slip over, and snugly conform to a horizontal ladder rung, wherein a resilient cord or an equivalent means is attached to the bottom portion of the can body so that tension that is applied to this cord, as the cord is stretched over the lower end of the strap, operates to secure the can to the ladder, wherein a removable cover is provided for the paint can, wherein a disposable liner lines the can body, and wherein a resilient cover is provided to convert a ladder rung having a circular cross section into a ladder rung having a generally rectangular cross section.

SUMMARY OF THE INVENTION

The container support device and apparatus of the present invention is operable with a container, or can of any desired cross section, and provides both stability and safety when used in conjunction with a ladder. Preferably, the can includes a metal can body of a generally cylindrical cross section and has an open top. This can body is adapted to hold paint, other paint cans, tools, etc. When used with paint and the like, a disposable can liner is provided.

A relatively wide strap, preferably formed of a metal spring-like material, is attached to one vertical side wall of the can body. A mid portion of this strap is bent to form the strap into a generally U-shaped, downward facing, configuration having a mid located base portion, and having two downward extending legs. In an embodiment of the invention, this base portion is of an adjustable horizontal dimension to accommodate different size ladder rungs.

The first downward-extending strap leg is attached to the one vertical side wall of the can body. The base portion of the strap is configured to slip over a horizontal ladder rung, and snugly conforms to the external surface of either a ladder rung of rectangular cross section, or a ladder rung of circular cross section.

A manually-operable attachment means, preferably a resilient cord, such as a Bungee cord, is attached to the can body, and preferably to the lower portion of the can body. This cord is stretching over the lower end of the strap's second downward-extending leg. This cord securely traps the device of the invention to the ladder rung. The tension within the stretched cord further enhances the snug fit of the strap around the periphery of the ladder rung. The lower end of the strap's second leg may be bent outward to securely receive the cord.

As a feature of the invention, a manually-removable cover, preferably a plastic snap-on cover, is provided to close the open top of the can as is desired.

As a feature of the invention, the above-described strap is relatively wide in the direction in which the rung extends, thereby preventing side sway of the can body when the can is attached to the ladder rung.

The support device of the invention securely engages the ladder rung by using relatively stiff spring metal when forming the strap. The support device of the invention will operate satisfactory without use of the above-described tensioning device or cord. However, use of an auxiliary latching means of this general type for securing and/or applying tension to the strap relative to the can body is preferred. This latching means may comprise a mechanical latch, or other type of equivalent arrangement that functions in the manner of the above-described elastic cord.

An object of the present invention is to provide a container support that is operable to support a container relative to a ladder that has two horizontally spaced side rails, and a plurality of vertically spaced ladder rungs extend between the two side rails. The support of the invention comprises a container having a vertically extending wall, a U-shaped strap having a generally horizontal base portion, a first downward extending leg located on a first side of the base portion, and a second downward extending leg located on a second side of the base portion, the base portion and the first and second legs defining a downward extending U-shaped mounting means that is configured to be placed over a horizontal ladder rung so as to physically wrap the ladder rung, and thereby mount the container to the ladder rung. A horizontal dimension of the base portion may be adjustable to accommodate ladder rungs and ladder steps of different sizes.

As a feature of the invention, a means is provided for securing the first downward extending leg to the container wall, and manually-operable attachment means operates to selectively secure the U-shaped strap to a ladder rung as the U-shaped strap and the attachment means operate to physically surround and grip the ladder rung.

As a feature of the invention, the above-described attachment means comprises an elastic member, preferably a loop having a handle thereon, that is stretched when the elastic member is manually stretched to cooperating with the second downward extending leg of the U-shaped strap. In a preferred embodiment, this attachment means or loop is mounted on the bottom of the container. However, within the spirit and scope of the invention, this attachment means can be mounted on the second leg of the U-shaped member, in which case, the attachment means is selectively secured to the container body.

These and other objects, advantages and features of the invention will be apparent to those of skill in the art upon reference to the following detailed description of the invention, which description makes reference to the drawing.

BRIEF DESCRIPTION OF THE DRAWING

FIG. 1 is a side view of a metal container support in accordance with the invention, the container support being mounted on a ladder rung showing two positions of a manually operable elastic cord that is selectively usable to wrap about the second downward extending leg of a U-shaped strap, and showing a flexible and disposable plastic bag positioned over the open top of the container, this bag being insertable in the container when the container is to be used with paint and the like.

DETAILED DESCRIPTION OF THE INVENTION

Figure 1:
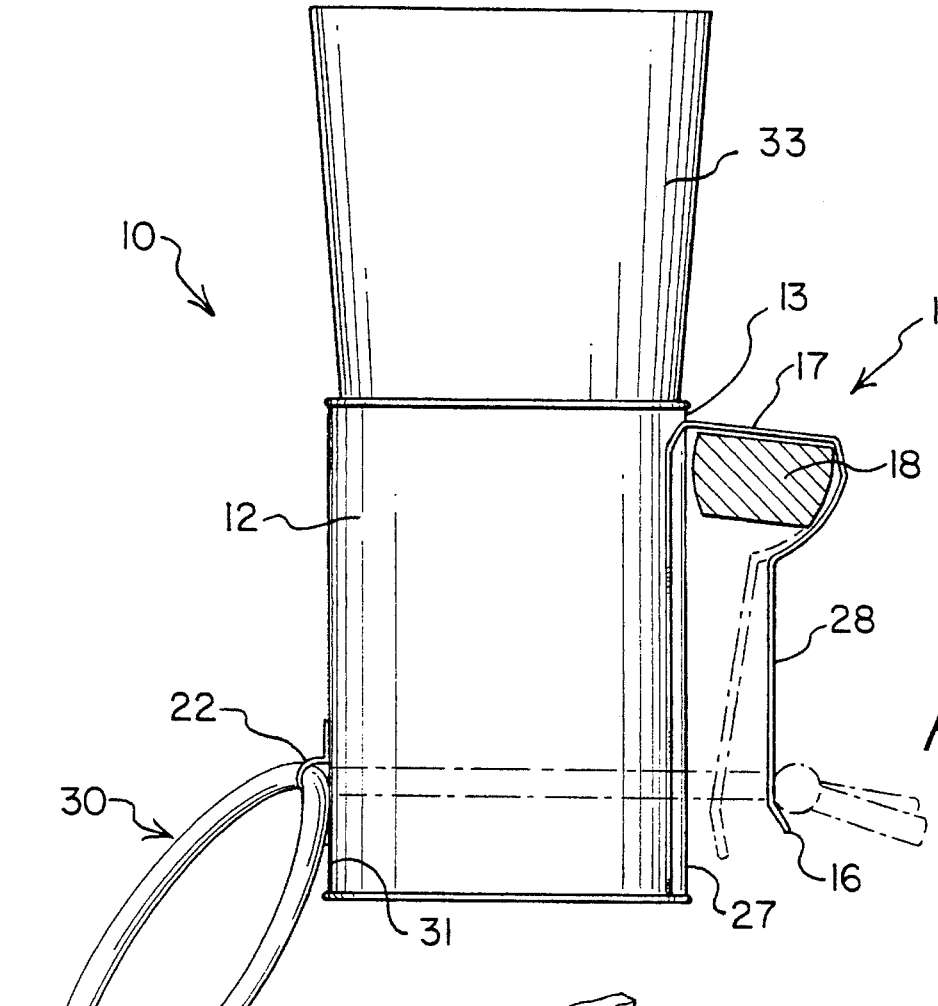
Figure 10:
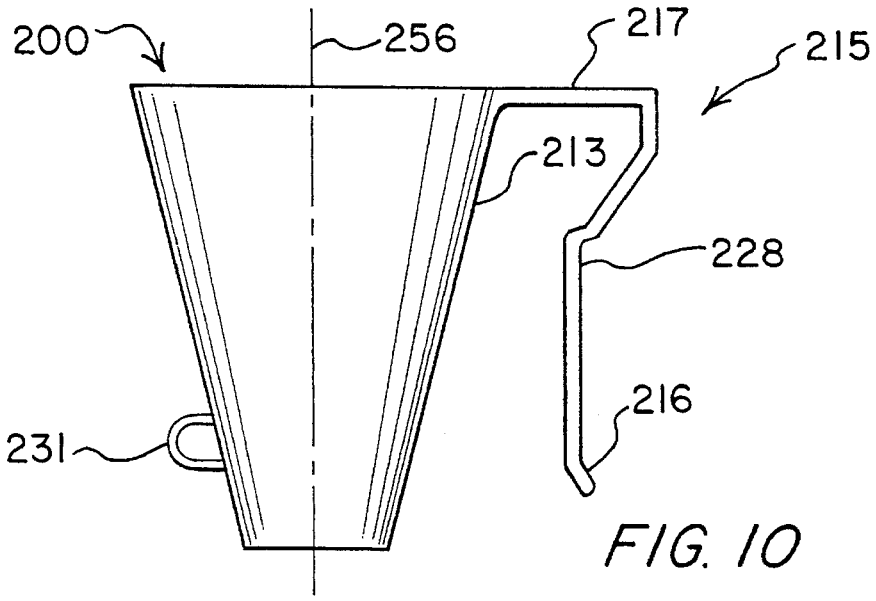
FIG. 10 is a side view of another injection molded plastic container support in accordance with the invention wherein the container is cone shaped.

With reference to FIG. 1, the metal container support device or paint can caddy 10 of the present invention is operable with a container, can, or can body 12 of any desired size and/or cross section; for example, FIG. 10 shows an injection molded plastic embodiment of the invention wherein the can body 212 is cone shaped, and has a vertical central axis 256.

Figure 4:
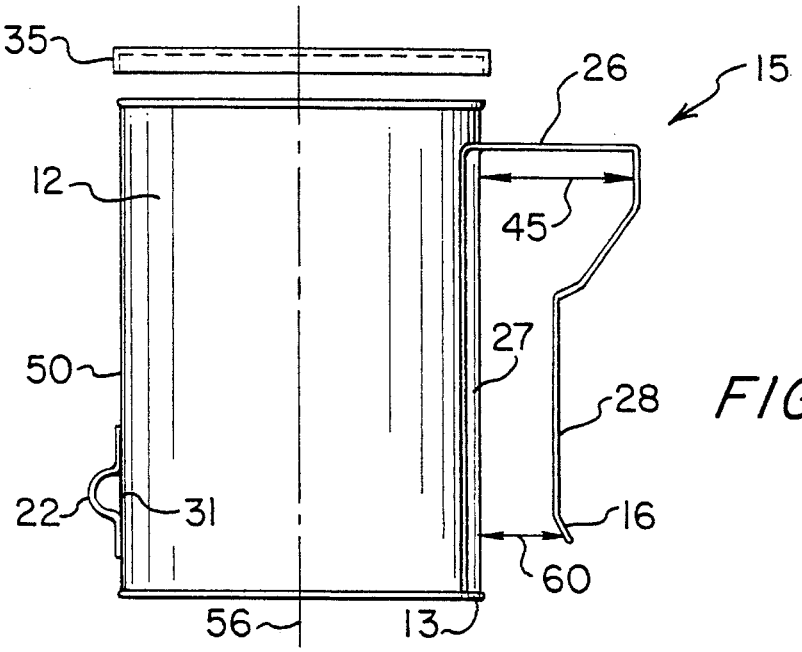
FIG. 4 is a side view of the device of FIG. 1 showing an optional cover for the container.
Figure 7:
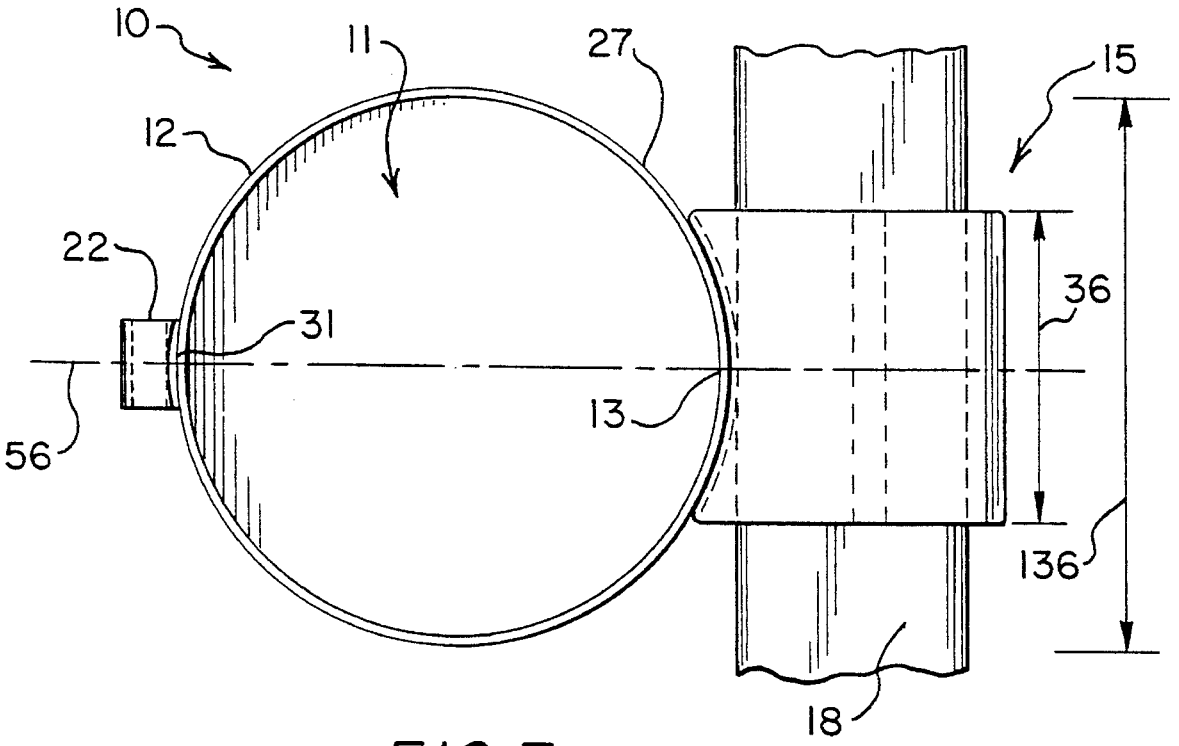
FIG. 7 is a top view of the container support of the invention as it is mounted on a ladder rung.

In the embodiment of FIG. 1, a metal can body 12 of a generally cylindrical cross section is provided having a vertical central axis 56, as shown in FIGS. 4 and 7. In all embodiments of the invention, the can body has a generally open top, such as is indicated at 11 in FIG. 7.

Can body 12 is adapted to hold paint, other paint cans, tools, etc., that are used by an artisan occupying an extension ladder or a step ladder. Use of the invention with well-known aluminum or fiberglass extensions ladders is contemplated wherein the ladder rungs comprise downward facing U-shaped horizontal step members. Step member of this U-shape cross section, or rectangular shape cross section, provide an upper horizontal step surface that facilitates location of the invention on this horizontal surface. While use with a ladder rung of generally rectangular cross section is preferred, the invention is not limited thereto. For example, FIG. 8 shows a feature of the invention whereby a U-shaped resilient rubber cover 130 is provided to convert a ladder rung 18 having a circular cross section into a ladder rung having a generally rectangular cross section.

Figure 8:
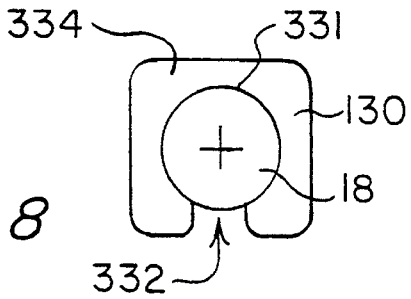
FIG. 8 shows a feature of the invention whereby a resilient cover is provided to convert a ladder rung of circular cross section into a ladder rung of generally rectangular cross section.

U-shaped rubber cover 130 of FIG. 8 has a linear central axis 330, an inner surface 331 of generally circular cross section, an elongated opening 332 formed therein generally parallel to central axis 330, and outer surface 334 of generally rectangular cross section. By way of opening 332, cover 130 is intended to be located on a circular cross section ladder rung 18, directly under a strap 17,117,217 in accordance with the invention.

In the FIG. 1 embodiment of the invention, a relatively wide strap 15, preferably formed of a metal spring-like material, is attached to one vertical side wall 13 of can body 12. As best seen in FIG. 4, a mid portion 26 of this strap is bent to form strap 15 into a downward facing generally U-shaped configuration having a mid located horizontal base portion 26, and having two vertical downward extending legs 27,28. The first downward extending leg 27 is attached to the side wall 13 of can body 12, as by welding or the like. The base portion 26 of strap 15 is configured to slip over a horizontal ladder rung, such as 18, as shown in FIG. 1 for example. Strap 15 is configured to snugly conform to the external surface of a ladder rung of rectangular cross section, a ladder rung of circular cross section, or a step ladder step of generally rectangular cross section.

Figure 6:
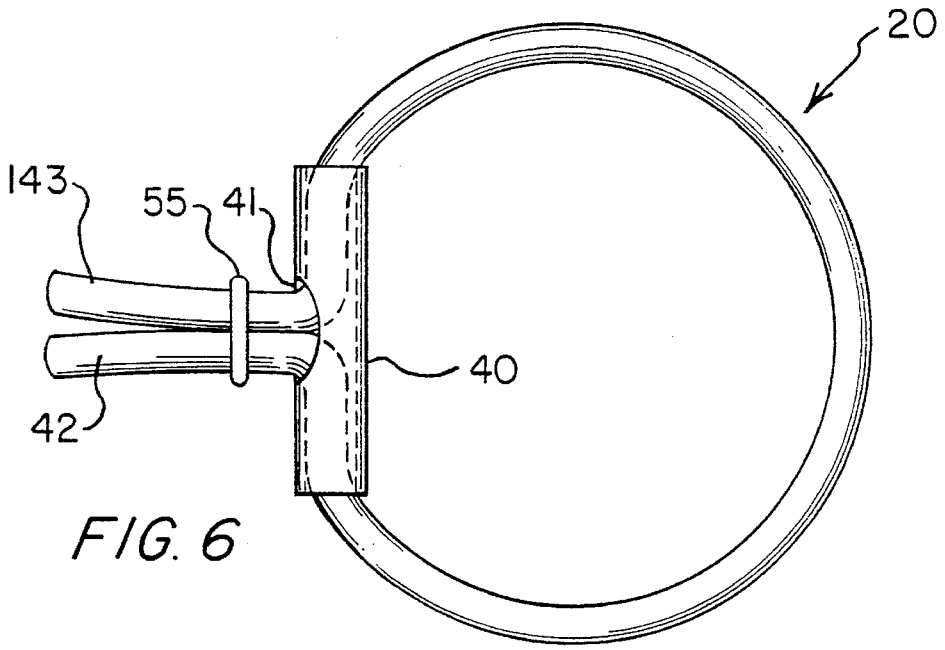
FIG. 6 is a plan view of the details of construction of the elastic loop shown in FIG. 1.

A manually-operable attachment means 30, preferably a resilient cord loop 20 shown in plan view in FIG. 6, such as a Bungee cord loop, is attached to can body 12, and preferably is attached to the lower portion 31 of can body 12 at a position that is generally diametrically opposed to the mounting position of strap leg 27. As has been noted, loop 20 can be attached to the second downward extending leg 28, if desired.

In operation, cord 20 is stretching over the lower end 16 of the strap's second downward extending leg 28, to assume the dotted line position that is shown in FIG. 1. Cord 20 operates to securely trap support device 10 of the invention to ladder rung 18. The tension within stretched cord 20 further enhances the snug fit of strap 15 around the periphery of ladder rung 18. It will be noted that in accordance with a feature of the invention, the lower end 16 of leg 28 is bent away from container 12, bent portion 16 operating to minimize the likelihood of slippage of cord loop 20 off of the second downward extending leg 28.

As a feature of the invention, a manually-removable cover 35, as shown in FIG. 4, is provided to close the open top of can 12, as is desired. Preferably, cover 35 is a plastic snap-on cover of well-known design.

As a feature of the invention, the width dimension 36 of strap 15, as shown in FIG. 7, is relatively wide in the horizontal direction generally parallel to the elongated axis of ladder rung 18; for example, in the range of about 2 to 4 inches wide, thereby preventing side sway of the can body 12 about a generally horizontal axis 56 when the can is attached to and mounted on ladder rung 18. Relative to FIG. 8, rubber cover 130 that is operable to convert a circular cross section rung 18 into a rectangular cross section rung is somewhat wider than the corresponding horizontal width 36 of strap 15; for example, see the horizontal width 136 of cover 130 shown in FIG. 8.

As a further feature of the invention, a disposable, flexible plastic bag, or liner 33, is provided for container 12, as shown in FIG. 1, to enable easy reuse of container 12 with paint and the like.

The support device 10 of the invention securely engages a ladder rung, such as 18, by using relatively stiff spring metal when forming strap 15. A nonlimiting example of the type of metal to use is 10-gauge galvanized sheet metal, or the equivalent. Support device 10 of the invention will operate satisfactory without use of the above-described tensioning device or cord 20. However, use of an auxiliary latching means of this general type for securing and/or applying tension to strap leg 28 relative to can body 12 is preferred. Stated in a different manner, it is to be noted that due to the construction and arrangement of strap 15, can body 12 is reliably secured to ladder rung 18 in the absence of the use of cord loop 20. While use of cord 20 is preferred, should cord 20 slip or break, the construction and arrangement of strap 15 ensures that can body 12 remains reliably secured to ladder rung 18.

In operation, it has been observed that without the use of a means, such as cord 20, the plane of the top rim of can body 12 may assume a somewhat non-horizontal position, and when cord 20 is then stretched into place over the bottom portion 16 of strap leg 28, the conformance of U-shaped strap 15 to the ladder rung, as is produced by the tension within cord 20, operates to swing can body 12 about a horizontal axis that is generally parallel to the ladder rung, so as to position the top rim of can body 12 more nearly horizontal.

Within the spirit and scope of the invention latching means 20 may comprise a mechanical latch, a spring latch, or other type of equivalent arrangement that functions in the manner of the above-described elastic cord 20.

Figure 2:
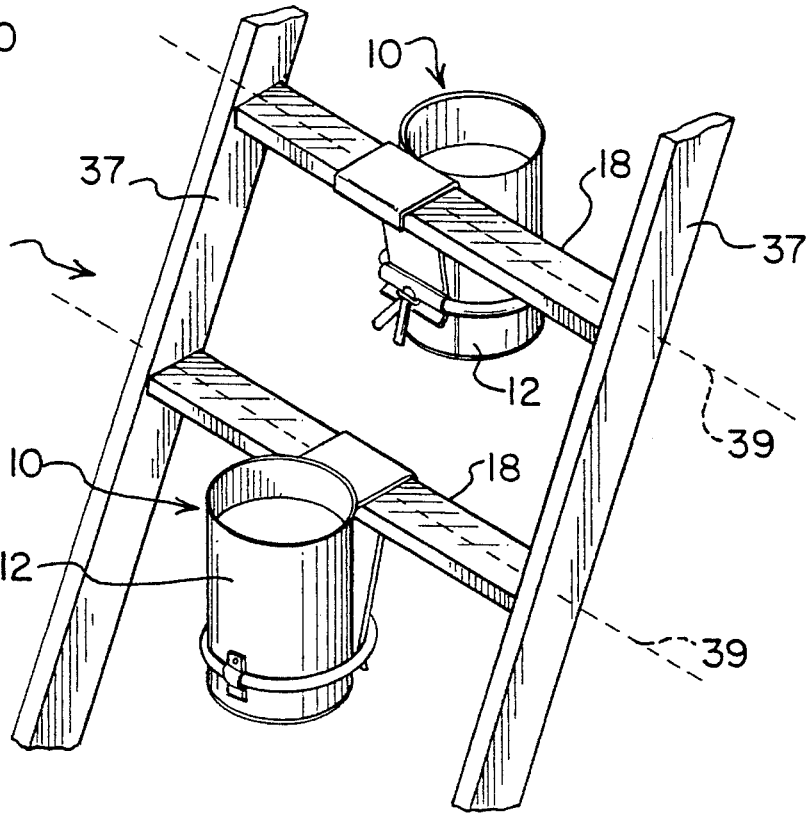
FIG. 2 shows two positions of the container support of the invention as the container support is selectively used to mount a container either to the front or to the rear of an inclined extension ladder.

FIG. 2 shows a versatility of the present invention wherein paint caddy 10 is selectively supported in one of two positions, as container support 10 is selectively used to mount container 12 either to the front (i.e., the lower location in FIG. 2), or to the rear (i.e., the upper location in FIG. 2) relative to an inclined extension ladder 38 having two parallel side rails 37, and a plurality of parallel ladder rungs extending between side rails 37. It should be noted that the utility of the invention provides that support devices 10 can be moved to either the left or to the right along the elongated axis 39 of a ladder rung, to thereby accommodate both left and right handed individuals. In addition, container support 10 can be used at the generally vertical midpoint of an extension ladder, where two extension ladder sections overlap one another. When container support 10 is secured to the rear one of an extension ladder's multiple ladder sections, the ladder can be extended without interference occurring between container support 10 and the ladder rungs.

Figure 3:
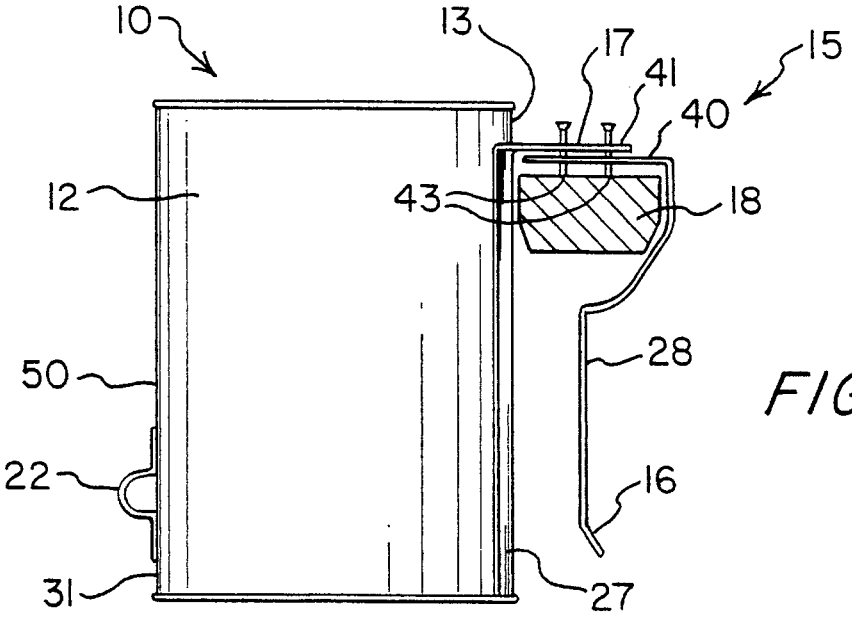
FIG. 3 is a side view similar to FIG. 1 wherein the base portion of the U-shaped strap is of an adjustable horizontal dimension to accommodate different size extension ladder rungs or step ladder steps.
Figure 5:
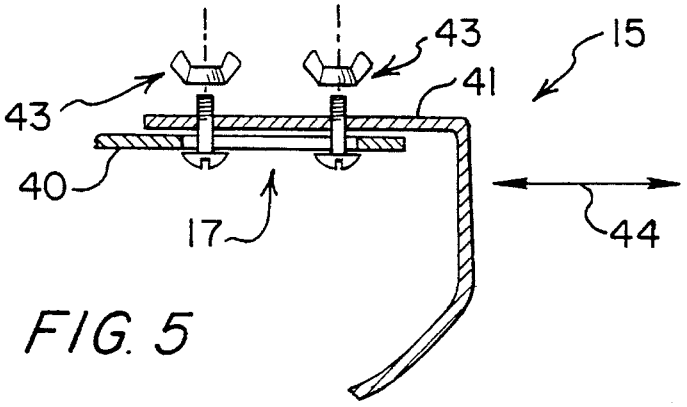
FIG. 5 is a partial exploded view of the modified device shown in FIG. 3.

As a feature of the invention, the generally horizontal, upper or base portion 17 of downward facing U-shaped strap 15 may be of a manually-adjustable horizontal dimension. FIGS. 3 and 5 are side views similar to FIG. 1 wherein the base portion 17 of U-shaped strap 15 is provided with two mating members 40,41 that are selectively coupled together by way of bolts 43. When bolts 43 are loosened, members 40,41 can be moved horizontally, as shown by arrow 44, to facilitate adjustment of the horizontal dimension 45 of strap portion 17 (see FIG. 4), to thereby accommodate different size extension ladder rungs or step ladder steps.

While FIGS. 3 and 5 show the use of bolt-like fasteners, the invention is not to be so limited, since it is within the spirit and scope of the invention to use other well-known fastener means. For example, in the injection molded embodiments of the invention shown in FIGS. 9 and 10, the corresponding strap portions 117 and 217 thereof may be injection molded in two-part form, with side positioned, spring biased, and manually-operable push buttons located on one part, these bush buttons selectively operating to disengage from locking teeth in the other part, thus facilitating selective manual adjustment of the horizontal dimension of strap portions 117,217.

FIG. 6 is a plan view of the details of construction of the elastic loop 20 shown in FIG. 1. In this construction, loop 20 is formed of a length of Bungee cord that extends through a length of plastic tubing 40 having an opening 41 formed in one wall thereof. Tubing 40 comprises a manual handle for use in stretching loop 20. In operation, one end of loop 20 is threaded through a metal loop 20 that is attached to the side 50 of can body 12 (see FIGS. 1, 3, 4 and 7). The two ends 42,143 of loop 20 are then passed through opening 41 that is formed in the side of tubing 40, and a wire clamp 55 is secured to cord ends 42,143.

While strap arms 27,28 are configured to secure device 10 on a ladder rung without the use of cord 20, as a feature of the invention, the horizontal spacing 60 of strap arms 27,28, as shown in FIG. 4 for example, is such that a vibration, or snapping action, does not occur when device 10 is mounted on a ladder rung. In this way, spilling of paint and the like due to agitation is minimized, or totally avoided, as device 10 is mounted to a ladder rung.

When strap 15 is adjusted as in FIGS. 3 and 5, the lower end 16 of arm 28 also moves horizontally. In this case, the use of a self-compensating elastic band 20 accommodates the adjusted position of arm 28. The key to this feature of the invention being that an air gap is always maintained between the side 27 of can 12 and the lower end 16 of arm 28. Moreover, it should be noted that in the event that band 20 should break, can 12 remains securely mounted on the ladder rung; i.e., band 20 is not required to perform the single effect of mounting device 10 to the ladder rung.

Figure 9:
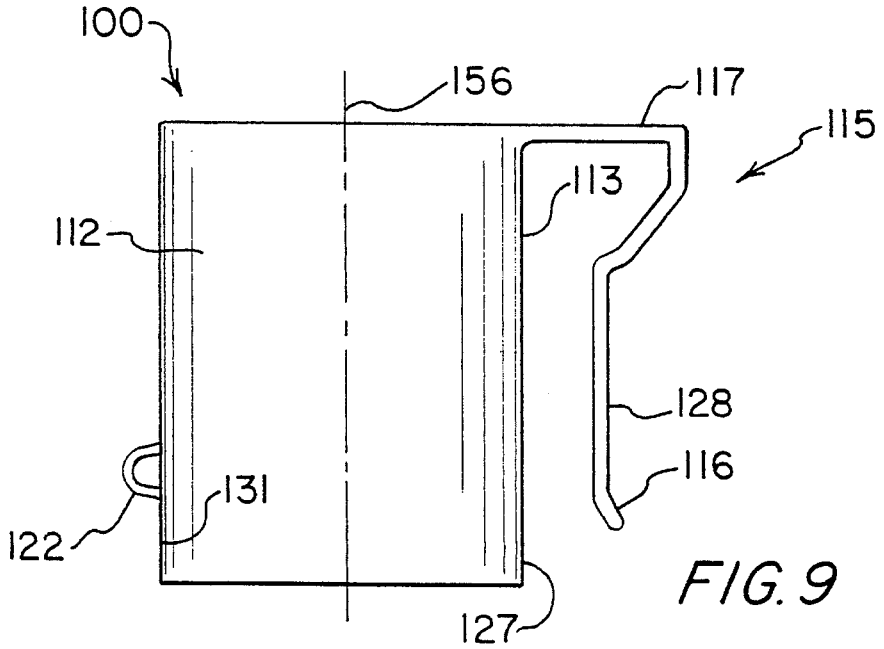
FIG. 9 is a side view of an injection molded plastic container support in accordance with the invention wherein the container is cylindrical in cross section.

FIG. 9 is a side view of an injection molded plastic container support 100 in accordance with the invention wherein container 112 is cylindrical in cross section, and has a vertical central axis 156. FIG. 10 is a side view of another injection molded plastic container support 200 in accordance with the invention wherein container 212 is cone shaped and has a vertical central axis 256. The FIG. 10 embodiment of the invention facilitates storage of a plurality of the supports 200 by way of vertical nesting. In these two plastic embodiments of the invention, the base portions 117,217 of straps 115,215 are shown as being formed integrally with can body 112,212, and extending from the upper rim of the can body. However, base portions 117,217 can also extend from can side walls 113,213 at a position somewhat below the upper rim of the can body.

The type of plastic to use in the FIG. 9 and 10 embodiments of the invention is not critical. All that is required is that the selected plastic provide the strength and spring effect that is utilized by strap portions 115 and 215 thereof, as above described relative to the metal embodiment of the invention. It is preferred that the selected plastic also provide good release characteristics relative to a layer of dried paint, thus enabling easy cleaning of the body 112,212, and generally eliminating the need for a liner, such as 33 shown in FIG. 1.

While not critical to the invention, it may be desirable that the various can bodies above described include a conventional and well-known paint can handle (not shown) to facilitate manual transport of devices in accordance with the invention.

While the invention has been described in detail while making reference to preferred embodiments thereof, it is recognized that upon learning of the invention, others will readily visualize yet other embodiments that are within the spirit and scope of the invention. Thus, this detailed description should not be taken as a limitation on the spirit and scope of the invention.

What is claimed is:

1. A container support operable to support a container relative to a ladder that has a pair of spaced and generally horizontal side rails and a plurality of vertically spaced ladder rungs extending between said side rails, the support comprising:

a container having a generally downward extending wall;

a strap having a generally horizontal base portion having a first and a second end, said first end of said base portion terminating at said container wall, said strap having a downward extending leg terminating at said second end of said base portion;

said base portion, said container wall, and said strap leg defining a downward facing U-shaped mounting means that is operable to be placed over and wrap a ladder rung; and manually-operable attachment means secured to said container and to said downward extending leg;

said attachment means operating to secure said U-shaped mounting means to a ladder rung as said mounting means and said attachment means operate to physically surround and grip the ladder rung.

2. The support of claim 1 wherein said attachment means comprises an elastic member that is secured to said container and is stretched to cooperating with said downward extending leg.

3. The support of claim 2 wherein said elastic member is formed as an elastic loop.

4. The support of claim 3 wherein said base portion of said strap physically engages the ladder rung and is provided with a width sufficient to minimize sway of said container.

5. The support of claim 4 including handle means mounted on said loop to aid in manual stretching of said loop.

6. The support of claim 5 including means securing said loop to said a second wall of said container that is generally diametrically opposed to said downward-extending container wall.

7. The support of claim 6 wherein said handle means is mounted to said loop at a position that is generally diametrically opposed to said securing of said loop to said second container wall.

8. The support of claim 7 wherein said downward-extending leg includes a portion that is bent away from said container, said bent portion operating to minimize the likelihood of slippage of said loop off of said downward-extending leg.

9. The support of claim 8 including:

a disposable liner in said container.

10. The support of claim 1 wherein said generally horizontal base portion is of a manually-adjustable dimension.

11. The support of claim 10 wherein said attachment means comprises an elastic loop that is secured to said container and is stretched to cooperating with said container and said downward extending leg.

12. The support of claim 11 wherein said loop includes a handle operable to facilitate said stretching.

13. The support of claim 12 wherein said base portion of said strap physically engages the ladder rung and is provided with a width sufficient to minimize sway of said container.

14. The support of claim 13 including:

means securing said loop to said container at a position that is generally opposed to said container wall;

means securing said handle means to said loop at a position that is generally diametrically opposed to said securing of said loop to said container; and said downward extending leg having a portion thereof that is bent to accept said loop.

15. The support of claim 14 including:

a disposable liner in said container.

16. The support of claim 1 wherein said container is formed of an injection molded plastic.

17. The support of claim 16 wherein said container is an open top cylinder having generally vertical central axis.

18. The support of claim 17 wherein said attachment means comprises an elastic member that is secured to said container and is stretched to cooperating with said downward extending leg.

19. The support of claim 18 wherein said elastic member is formed as a manually-stretchable elastic loop.

20. In combination:

a ladder having a pair of spaced side rails and a plurality of spaced and ladder rungs that extend between said side rails;

a container having a generally vertical wall;

a U-shaped strap having a generally horizontal base portion, a first downward extending leg located on a first side of said base portion, and a second downward extending leg located on a second side of said base portion;

said first and second legs extending downward, and said base portion being dimensioned to space said first and second legs a distance that is generally equal to a ladder rung;

means securing said first leg to said generally vertical wall of said container;

said U-shaped strap define a mounting means operable to be placed over a selected ladder rung so as to physically wrap the ladder rung and physically secure said container thereto:

manually operable attachment means; and said attachment means being selectively operable for attachment to a bottom portion of said second leg and to said container, said attachment means operating to secure said U-shaped strap to the ladder rung as said U-shaped strap and said attachment means operate to physically surround and grip the ladder rung.

21. The combination of claim 20 wherein said attachment means comprises an elastic member that is manually stretched to cooperating with said bottom portion of said second leg of said U-shaped strap and with said container.

22. The combination of claim 21 wherein said elastic member is formed as a closed loop.

23. The combination of claim 22 wherein said base portion of said strap physically engages the ladder rung and is provided with a width sufficient to minimize sway of said container about a horizontal axis.

24. The combination of claim 23 wherein said generally horizontal base portion of said U-shaped strap is adjustable to accommodate different size ladder rungs.

25. The combination of claim 24 including:

a disposable liner within said container.

26. The combination of claim 25 wherein said ladder rungs have a generally circular cross section, including:

an elongated resilient adaptor having a central axis, having an inner surface of generally circular cross section, having an elongated opening formed therein generally parallel to said central axis, and having an outer surface of generally rectangular cross section, said adaptor being located on a ladder rung under said U-shaped strap.

27. In combination:

a container having a first upward extending wall;

a strap having a generally horizontal base portion with a first and a second side, said first side of said base portion terminating at said container wall, and a downward extending leg having an upper end terminating at said second side of said base portion and having a bottom end;

said base portion being dimensioned to space said container wall and said downward extending leg a distance to facilitate mounting said container and said strap on a ladder rung;

said strap defining a mounting means operable to be placed over a ladder rung so as to physically wrap the ladder rung and physically secure said container to the ladder rung;

manually operable attachment means;

said attachment means being attached to a bottom portion of said container; and said bottom end of said leg being configured to releasably accept said attachment means.

28. The combination of claim 27 wherein said attachment means comprises an elastic loop that is manually stretched to cooperating with said container and said bottom end of said leg.

29. The combination of claim 28 wherein said generally horizontal base portion of said strap is adjustable to accommodate different size ladder rungs.

30. The combination of claim 29 including:

a removable liner lining said container.

31. The combination of claim 29 wherein said container and strap are formed of a material selected from the group metal and plastic.

32. The combination of claim 31 including:

an elongated resilient adaptor formed of a rubber-like material located under said strap, said adaptor having a central axis, having an inner surface of generally circular cross section, having an elongated opening formed therein generally parallel to said central axis, and having an outer surface of generally rectangular cross section.

* * * * *